US007377135B2

(12) United States Patent
Copus

(10) Patent No.: US 7,377,135 B2
(45) Date of Patent: May 27, 2008

(54) MULTIPURPOSE PORTABLE LOCK

(76) Inventor: Gary D. Copus, 12062 Mead Rd. (P.O. Box 194), Middletown, CA (US) 95461

( * ) Notice: Subject to any disclaimer, the term of this patent is extended or adjusted under 35 U.S.C. 154(b) by 0 days.

(21) Appl. No.: 11/422,578

(22) Filed: Jun. 6, 2006

(65) Prior Publication Data

US 2006/0272365 A1 Dec. 7, 2006

Related U.S. Application Data

(60) Provisional application No. 60/688,110, filed on Jun. 6, 2005.

(51) Int. Cl.
*E05B 73/00* (2006.01)

(52) U.S. Cl. ..... 70/14; 70/19; 70/38 A; 70/51; 70/94; 70/DIG. 65; 292/258; 292/259 R; 292/288; 292/289

(58) Field of Classification Search ..... 70/91, 70/93, 94, 14, 19, DIG. 65, 38 A, 51–53, 70/177, 178, 202, 211; 292/256, 258, 259, 292/292, 288–290, 295–298, DIG. 44, 259 R
See application file for complete search history.

(56) References Cited

U.S. PATENT DOCUMENTS

| | | | | | |
|---|---|---|---|---|---|
| 180,504 | A | * | 8/1876 | Thompson | 70/38 A |
| 1,097,081 | A | * | 5/1914 | Coon | 70/203 |
| 1,343,870 | A | | 6/1920 | James | |
| 1,395,970 | A | | 11/1921 | Nidermaier | |
| 1,400,415 | A | * | 12/1921 | Callahan | 70/211 |
| 1,530,177 | A | * | 3/1925 | Heyer | 70/39 |
| 1,566,473 | A | * | 12/1925 | Gibson | 70/38 A |
| 1,594,683 | A | * | 8/1926 | Nelson | 70/211 |
| 1,719,637 | A | * | 7/1929 | Werner | 70/38 A |
| 2,556,900 | A | * | 6/1951 | Buschhorn | 70/230 |
| 3,084,532 | A | | 4/1963 | Williams | |
| 3,667,260 | A | * | 6/1972 | Foote | 70/159 |
| 3,738,137 | A | * | 6/1973 | Jones | 70/428 |
| 3,855,825 | A | * | 12/1974 | Pickard | 70/14 |
| 3,980,328 | A | * | 9/1976 | Pearson | 292/256 |
| 4,003,227 | A | * | 1/1977 | Casey | 70/14 |
| 4,281,865 | A | * | 8/1981 | Nicholson | 292/258 |
| 4,334,705 | A | * | 6/1982 | Rumph | 292/288 |
| 4,426,861 | A | | 1/1984 | Chillis | |
| 4,852,921 | A | * | 8/1989 | Gilbert et al. | 292/259 R |
| 5,119,651 | A | * | 6/1992 | Yang | 70/52 |
| 5,145,222 | A | * | 9/1992 | Meyer | 292/258 |
| 5,778,706 | A | | 7/1998 | Testa | |
| 6,434,979 | B1 | * | 8/2002 | Allen et al. | 70/14 |
| 7,117,698 | B2 | * | 10/2006 | Lai | 70/21 |

* cited by examiner

*Primary Examiner*—Lloyd A Gall
(74) *Attorney, Agent, or Firm*—Craig M. Stainbrook; Stainbrook & Stainbrook, LLP

(57) ABSTRACT

A portable multipurpose lock having a shackle base with two parallel rods having opposing interior sides with spaced-apart detents, an adjustable lock body with through holes for slidable insertion of the rods, a lock for engaging the rods to secure and lock the lock body on the rods, and one or more recesses formed in the shackle base, lock body, or both, which facilitates placement of the lock around an object or objects to be secured.

10 Claims, 14 Drawing Sheets

MULTIPURPOSE PORTABLE LOCK

CROSS REFERENCES TO RELATED APPLICATIONS

The present application claims the benefit of U.S. Provisional Patent Application Ser. No. 60/688,110, filed Jun. 6, 2005.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to portable locks, more particularly to portable locks for doors and certain movable objects, and still more particularly to a multipurpose portable lock utilizing notched parallel bars slidably inserted into openings in a receiving mechanism which houses a release and locking mechanism.

2. Discussion of Related Art Including Information Disclosed Under 37 CFR §§1.97, 1.98:

Portable locking devices are well known in the art. These devices are routinely used for securing doors to prevent unauthorized entry, and movable personal property against theft or unauthorized use.

U.S. Pat. No. 5,778,706, to Testa, teaches a marine anti-theft lock which impedes access to a nut securing a propeller on a drive shaft of an outboard engine. The lock has a two-part yoke which enable adjustment of the longitudinal dimension of the device, one part including a single notched rod for sliding into a locking receptacle.

U.S. Pat. No. 3,084,532, to Williams, teaches a sliding U-shaped shackle with a receptacle for receiving the arms of the shackle. The length is adjustable and it includes a keylock.

U.S. Pat. No. 1,395,970, to Nidermaier, teaches an automobile locking device having two shanks with hooked ends forming opposing shackles. The lengths of the shanks are adjustably insertable into a conventional combination lock body and are adapted for use with automobiles.

U.S. Pat. No. 596,237, to Damon, teaches U-shaped opposing shackles with integrated lock bodies. The lengths are adjustable, making the lock suitable for use in locking bicycles.

U.S. Pat. No. 1,343,870, to James, teaches a lock having a U-shaped yoke, a fixed arm, and an outwardly swinging arm, the inner portions of each arm having teeth. A lock block is provided to slidably move up the arms.

U.S. Pat. No. 4,426,861, to Chillis, discloses a security bracket for bicycles and motorcycles with brake handles. The locking device includes a small U-shaped shackle and a receptacle with a locking mechanism. The lock is used to lock the shackle so that the brake handle is pulled into the handlebar, thereby applying braking pressure and locking the front wheel without any device passing through the spokes.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is a multipurpose portable lock suitable for locking objects of widely varying sizes. In a first preferred embodiment, the inventive apparatus comprises a fixed shackle base having a substantially flat front side, a substantially flat rear side, right and left sides, a curved or rounded top, and a substantially planar bottom. The base further includes first and second rods extending in a parallel configuration from the bottom side of the lock in substantially the same plane as the front and back sides. Each rod includes a plurality of opposing detents or notches along their respective interior sides. The shackle base includes an extension arm that curves outwardly from the shackle base, but within the same plane as the shackle base, to form an elongate oblong recess. The shackle thus takes the general shape of a U, with the material bulk of the base in the base portion and the recess biased toward the extension arm. The extension arm includes a pin extending parallel to the first and second rods and also in substantially the same plane.

Next, the lock includes an adjustable lock body having generally flat front and rear sides, a right and left side, and a bottom and top side, the latter which opposes the bottom side of the shackle base. The lock body includes two through holes into which the first and second notched rods of the shackle base are inserted so that the lock body is slidably disposed on the rods. The lock body is selectively fixed to and released from any set of opposing detents with the key cylinder lock assembly. The lock body includes a curved outrigger arm extending outwardly from the lock body, and within the same plane as the lock body, to form an elongate oblong recess having substantially the same dimensions as the recess in the shackle base. The lock body arm includes a hole for receiving the pin in the shackle base arm. The lock body can be positioned and locked at any opposing pair of detents along the length of the rods so that it can be secured across and to any of a number of structures, such as a steering wheel and gear shift lever; gates; refrigerator door handles; conventional double door handles, and so forth.

In a second preferred embodiment of the present invention, the shackle base comprises a generally rectangular block, having a front surface, a back surface, a top, a bottom, a left side and a right side. The base further includes first and second rods extending in a parallel configuration from the bottom side of the lock in substantially the same plane as the front and back sides. Again, each rod includes a plurality of opposing detents or notches along their respective interior sides. The shackle base has a U-shaped channel extending from the back side of the shackle base, opposite the rods, the bottom of the channel extending perpendicular to the plane of the back of the shackle base, to the rear. The back arm of the channel slidably inserts into a third element of the locking, which is a suitably shaped mounting bracket affixed to a planar surface such as a wall.

The second preferred embodiment further includes an adjustable lock body having generally square and flat front and rear sides, a right and left side, and a bottom and top side. As with the first preferred embodiment, the lock body of the second preferred embodiment includes two through holes into which the first and second notched rods of the shackle base are inserted so that the lock body is slidably disposed on the rods. The lock body is selectively fixed to and released from any set of opposing detents with the key cylinder lock assembly.

The lock body is mounted to a generally rectangular base plate on the back side of the lock body with a plurality of mounting shafts. The base plate has a U-shaped recess or cut out above the mounting shafts and on its right (inboard) side to accommodate the insertion of a door handle shaft or a similar structure. In a third preferred embodiment, which is a slight variation on the second preferred embodiment, the U-shaped recess of the base plate is disposed between the mounting shafts.

Fourth and fifth preferred embodiments of the present invention are also variations on the second and third preferred embodiments, with the shackle body, rather than the lock body, mounted to the base plate.

It is therefore an object of the present invention to provide a new and improved multipurpose lock which is portable yet heavy duty.

It is another object of the present invention to provide a multipurpose portable lock adapted for use in locking single and double doors having a variety of handle configurations.

It is a further object of this invention to provide a portable lock for applications in locking steering wheels, bicycle wheels, gates and gear shift levers.

It is still another object of the present invention to provide a portable lock having a lock base with two notched rods extending through a lock body, such that the lock body can be slidably adjusted and locked at a number of lengths along the length of the notched rods.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIGS. 1-11 show various views of first through fifth preferred embodiments of the multipurpose security lock of the present invention.

FIG. 4 is an upper left front perspective view of a second preferred embodiment of the multipurpose portable lock of the present invention, showing the lock in the open configuration;

FIG. 5 is an upper left perspective view thereof showing the lock in the closed configuration;

FIG. 6 is an upper left perspective view of a third preferred embodiment of the inventive lock, showing the lock in the open configuration;

FIG. 7 is an upper left perspective view thereof showing the lock in the closed configuration;

FIG. 8 is an upper left perspective view of a fourth preferred embodiment of the inventive multipurpose portable lock, showing the lock in the open configuration;

FIG. 9 is an upper left perspective view thereof showing the lock in the closed configuration;

FIG. 10 is a perspective view of a fifth preferred embodiment of the multipurpose portable lock of the present invention, showing the lock in the open configuration; and FIG. 11 is an upper left perspective view thereof showing the lock in the closed configuration.

DETAILED DESCRIPTION OF THE INVENTION

Figure 1A:
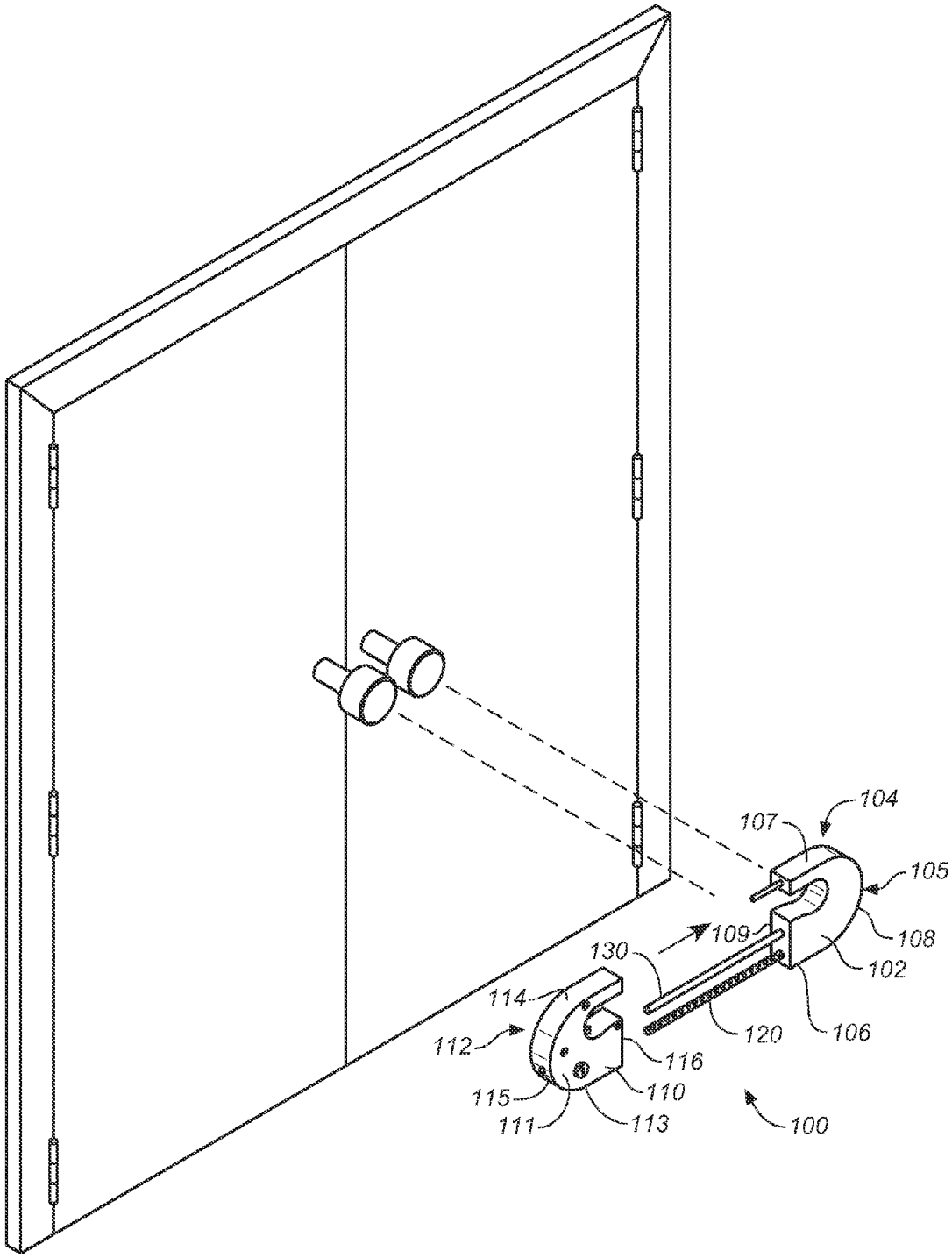
FIG. 1A is an upper left front perspective view of a first preferred embodiment of the multipurpose portable lock of the present invention, shown in the open position.

Referring to FIGS. 1 through 11, wherein like reference numerals refer to like components in the various views, there is illustrated a new and improved multipurpose portable lock, generally denominated 100 herein. Although the preferred embodiments include various configurations of lock body and shackle base, as well as other mounting and object engaging elements, each embodiment of the present invention incorporates the same essential locking mechanism.

FIG. 1A is an upper left front perspective view of a first preferred embodiment of the multipurpose portable lock 100 of the present invention. The shackle base 105 includes a substantially flat front side 102, a substantially flat rear side 104, right and left sides 106, 107, a curved or rounded top 108, and a substantially planar bottom 109.

The shackle base further includes a first shank or rod 120 and a second rod 130 extending in a parallel configuration from the bottom side of the lock in a plane substantially parallel to the planes of the front and back sides. An adjustable lock body 110 includes substantially flat front and rear sides 111, 112, a right side 113, and a left side 114, a bottom side 115, and top side 116, the latter which opposes the bottom side of the shackle base.

Figure 1B:
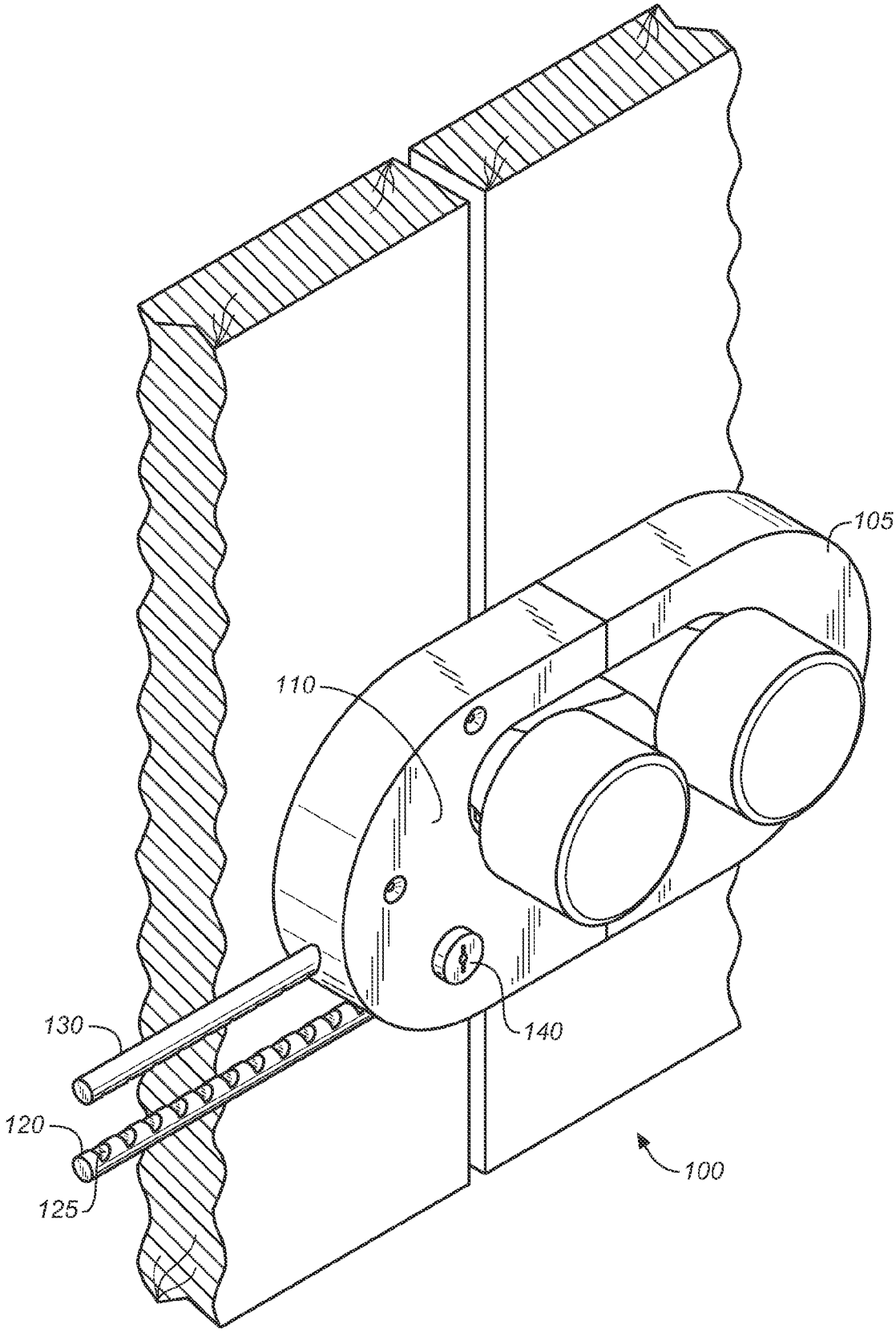
FIG. 1B is a perspective view thereof in the closed position.

FIG. 1B is an upper front left perspective view of the multipurpose portable lock 100 in the closed and locked position. This figure shows the shackle base 105 in close contact with the adjustable lock body 110. The first rod 120 and second rod 130 are visible extending through the adjustable lock body 110. The first rod 120 is seen to include evenly spaced detents or notches 125 which are mirrored and opposed in the second rod 130. Also depicted is a key cylinder lock assembly 140 located on the adjustable lock body 110.

Figure 2A:
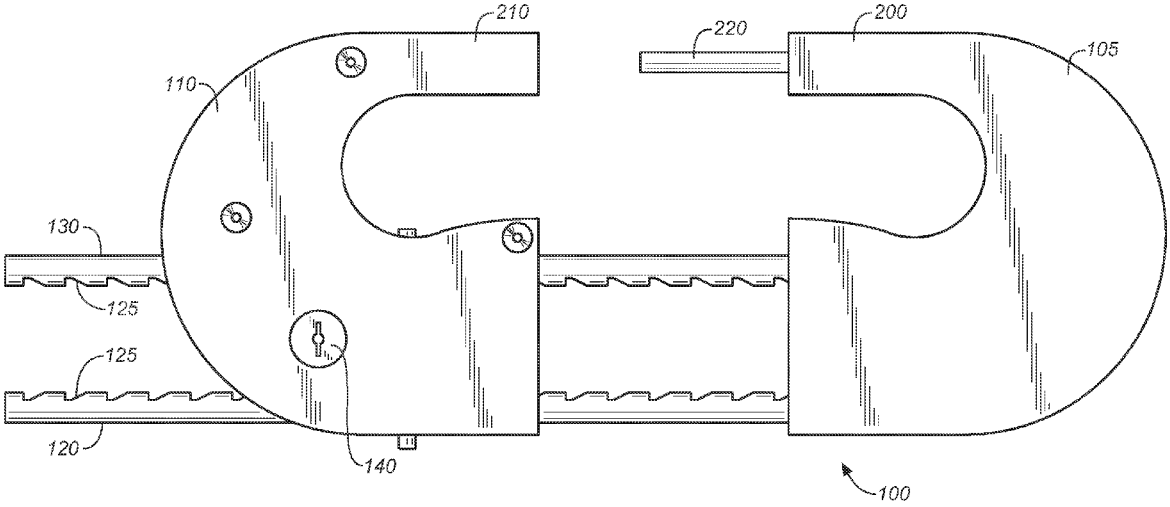
FIG. 2A is a front view in elevation thereof showing the lock in the open position.

FIG. 2A is a front view in elevation of the multipurpose portable lock 100 in the open position; the shackle body 105 and the adjustable lock body 110 are slidably separated along the lengths of the first and second rods 120, 130. The detents or notches 125 are seen to face one another on opposing interior sides on the rods. An extension arm 200 curves outwardly from the shackle base, and generally within the same plane as the shackle base 105, to form an elongate oblong recess.

Extending from the extension arm 200 is a pin 220. The adjustable lock body 110 includes a curved outrigger arm 210 extending outwardly from the lock body and substantially within the same plane as the lock body to form an elongate oblong recess having substantially the same dimensions as the recess in the shackle base and complementing the recess in the shackle base to form an opening into which objects may be secured through installation of the inventive lock.

Figure 2B:
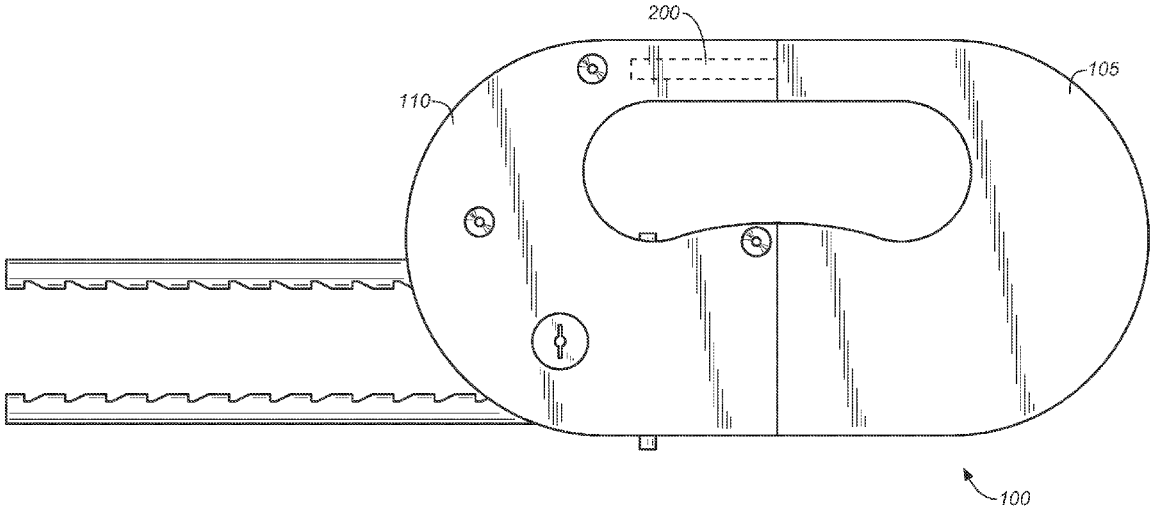
FIG. 2B is a front view in elevation thereof showing the lock in the closed position.

FIG. 2B is a front view in elevation of the multipurpose portable lock 100 in the closed and locked configuration, showing the shackle body 105 and the adjustable lock body 110 in close contact, and with pin 200 inserted into a corresponding hole in the outrigger arm 210.

Figure 3A:
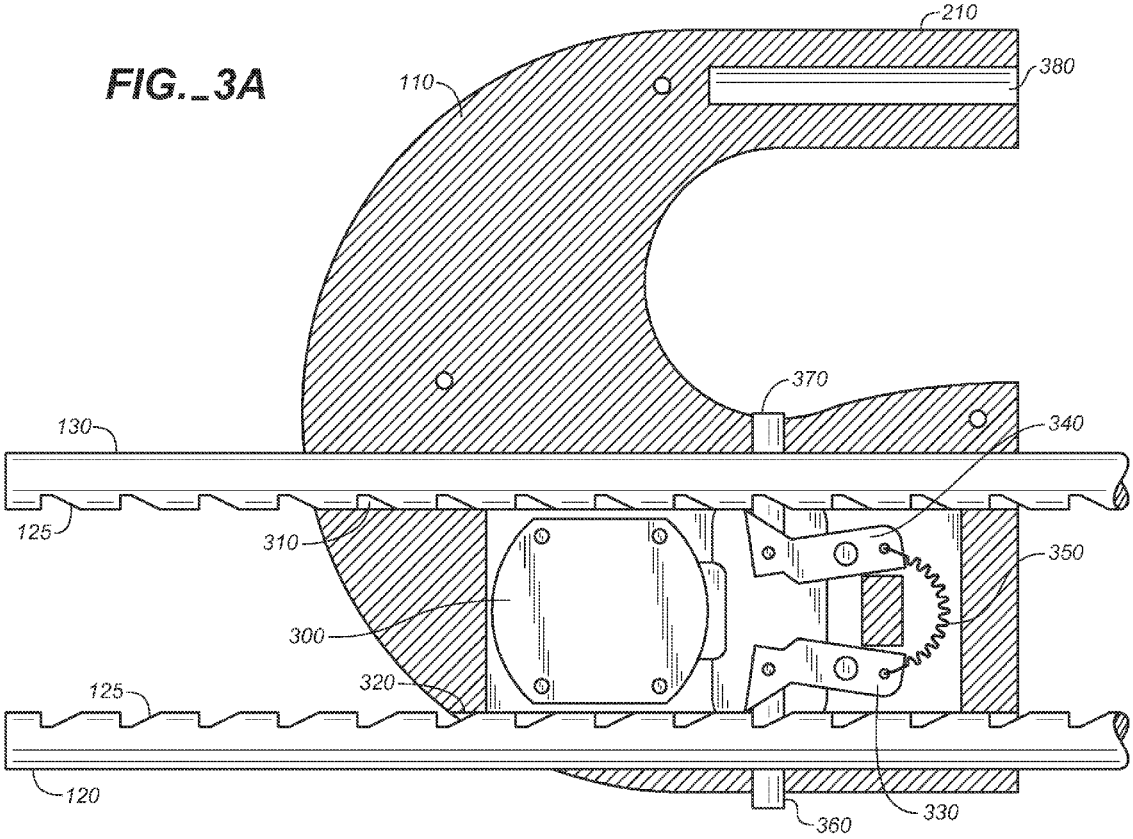
FIG. 3A is a cross-section front view in elevation showing the locking mechanism in the free position.

FIG. 3A is a cross-sectional front view in elevation of the lock body 110, showing the lock slide 300 disposed between the first rod 120 and the second rod 130, which are slidably inserted into a lower through hole 320 and an upper through hole 310, respectively. A pin recess 380 is visible in the outrigger arm 210. In this illustration, the lower dog 330 and upper dog 340 are not engaged in a detent but are urged by a spring 350 against the interior sides of the rods until such time as they come into register with a detent. However, pushing either the lower release pin 360 or the upper release pin 370 forces its corresponding dog out of its detent 125, and thereby translates force through spring 350 to the other dog, which is thereby also released, thereby allowing the lock body to slide freely on the first rod 120 and the second rod 130. Thus, one of the release pins must be depressed to allow continuous sliding of the lock body over the rods. Once a desired separation distance between the lock body and shackle base is reached, wherein an opening formed by the recesses fits suitable well over the objects to be secured, the release pin or pins may be released and the dogs are free to click into a detent.

Figure 3B:
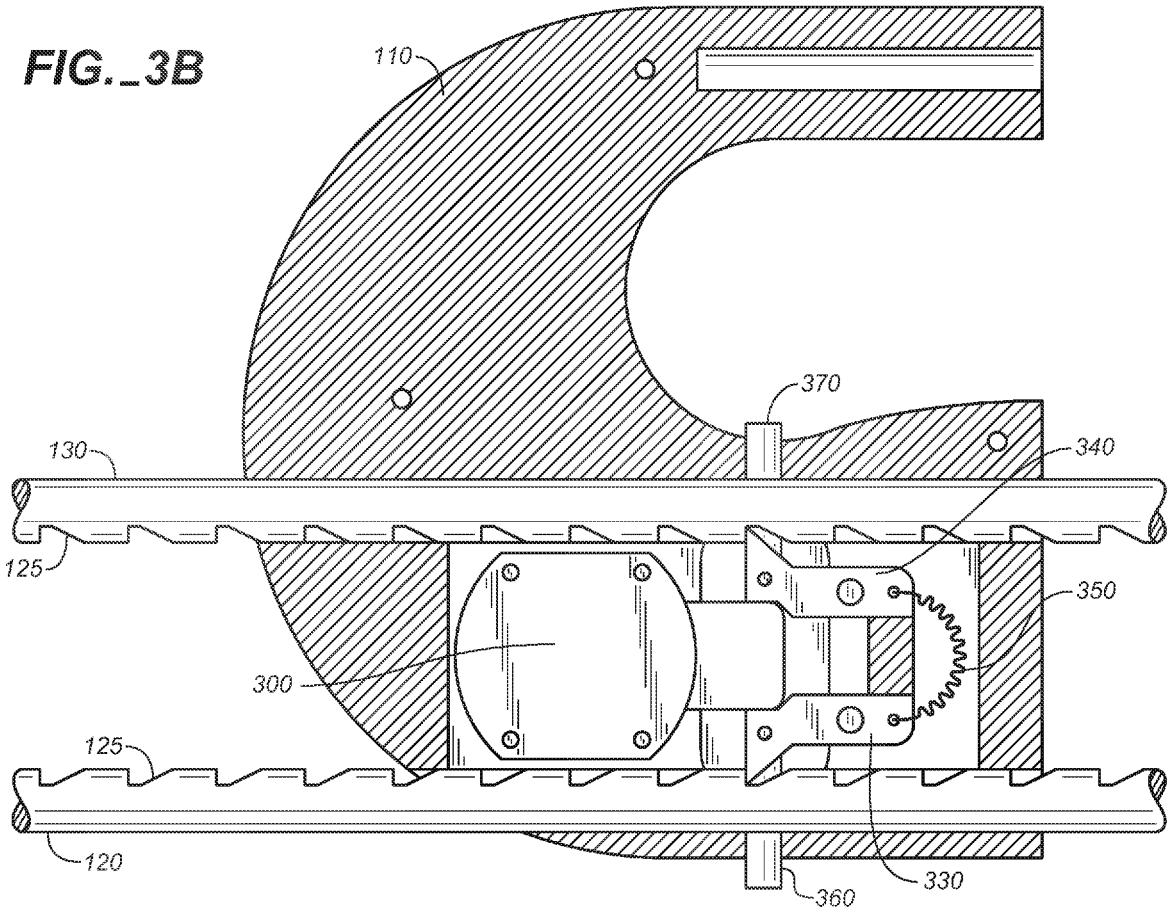
FIG. 3B is a cross-sectional front view in elevation showing the locking mechanism in the locked configuration.

FIG. 3B is a cross-sectional front view showing the lower dog 330 and upper dog 340 urged by spring 350 into locking engagement with a detent. The lower release pin 360 and the upper release pin 370 are free to slide outwardly to release the lower dog 330 and upper dog 340 into the notches 125, effectively locking the lock body from sliding in an outward direction. The key cylinder lock assembly 140 is then actuated to move lock slide 300 into position between the dogs and thus to prevent disengagement from the detents.

Figure 4:
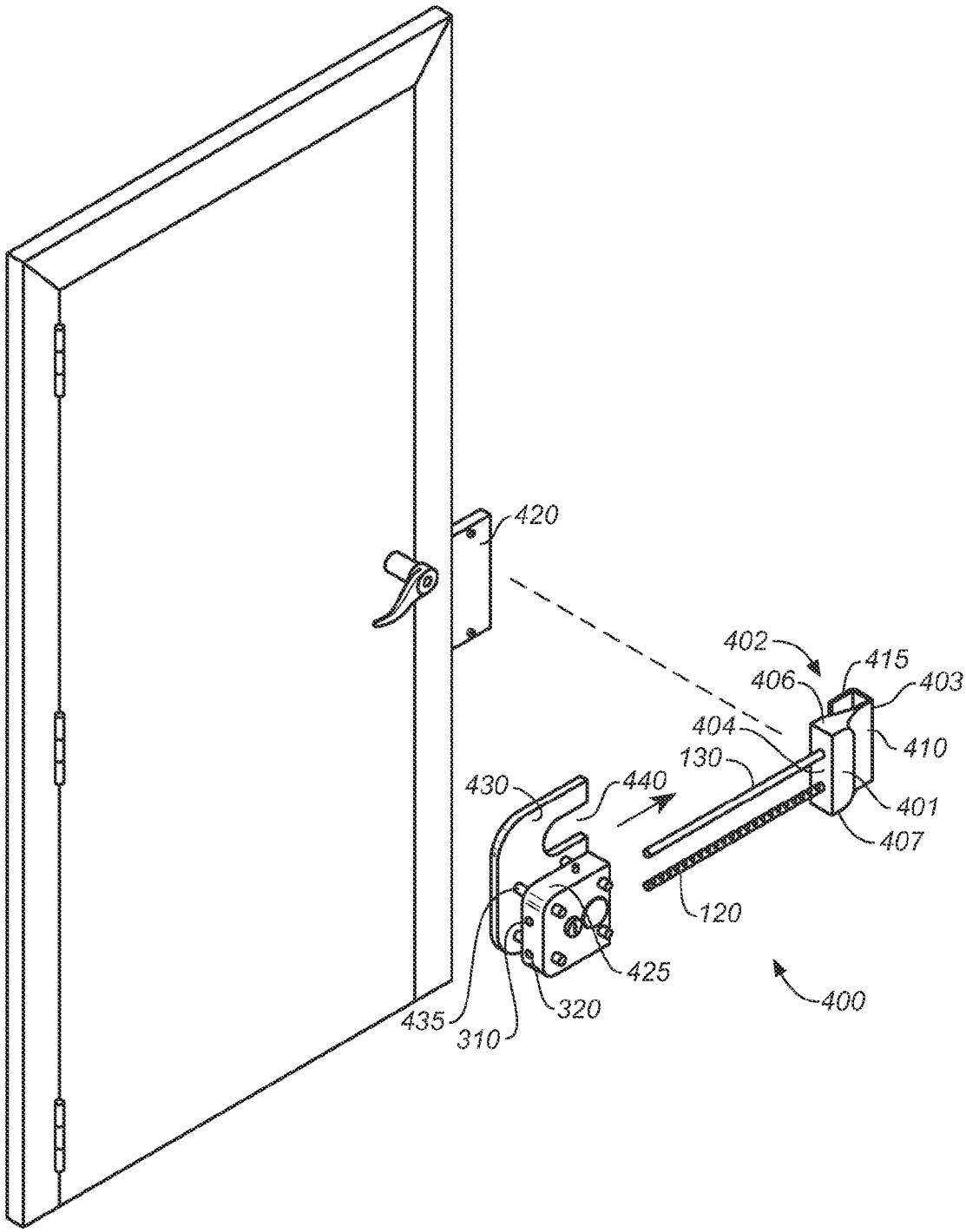

FIG. 4 is an upper left front perspective view of a second preferred embodiment of the multipurpose portable lock 400 in the open position. The shackle base 405 is a generally rectangular block, having a front surface 401, a back surface 402, a top 403, a bottom 404, a left side 406, and a right side 407. The shackle base further includes parallel first and second rods 120, 130, extending from the bottom side of the lock in a plane substantially parallel to the planes of the front and back sides.

The shackle base 405 further includes a U-shaped channel 410 extending from the back side of the shackle base 405 opposite the first rod 120 and the second rod 130, the bottom of the channel 410 extending perpendicular to the plane of the back of the shackle base, to the rear. The back arm of the channel 415 slidably inserts into a mounting bracket 420 which may be affixed to a planar surface such as a wall.

Much as in the first preferred embodiment, the adjustable lock body 425 has substantially planar front and rear sides, a right and left side, and a bottom and top side. The lock body also includes upper and lower through holes 310, 320 into which the first and second rods 120, 130 of the shackle base 410 are inserted, such that the lock body is slidably disposed on the rods.

However, in this embodiment, the rear side of the lock body 425 is mounted to, and spaced apart from, a mounting plate 430 on a plurality of mounting shafts 435. The rectangular mounting plate 430 has a U-shaped cut out 440 on its right side above the mounting shafts 435 to accommodate the insertion of a door handle shaft.

Figure 5:
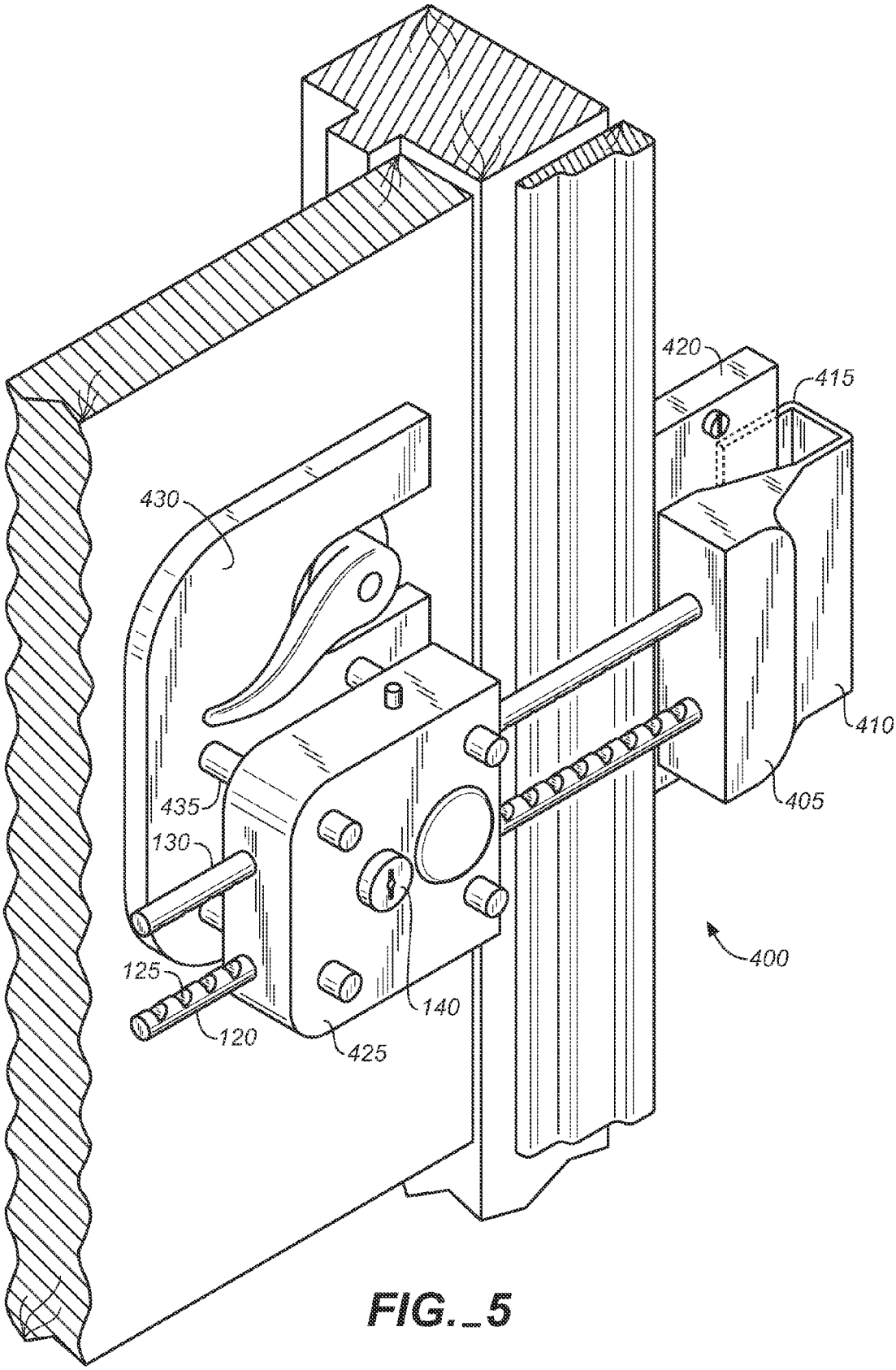

FIG. 5 is an upper left perspective view of second embodiment of the multipurpose portable look 400 in the closed position. The shackle base 405 has the back arm of the channel 415 slidably inserted into a mounting bracket 420, keeping in a static position. The lock body 425 is slidably disposed upon the first rod 120 and the second rod 130. A key cylinder lock assembly 140 is located in approximately the center of the adjustable lock body 425. The notches 125 are evident on the first rod 120 and are mirrored on the second rod 130, but are not visible in this perspective view. The lock body 425 is suspended from the mounting plate 430 with a plurality of mounting shafts 435. As will be immediately appreciated, The space between the mounting plate and the lock body allows the mounting plate to engage the flat surface of the door while the lock body is disposed over the handle of the door.

Figure 6:
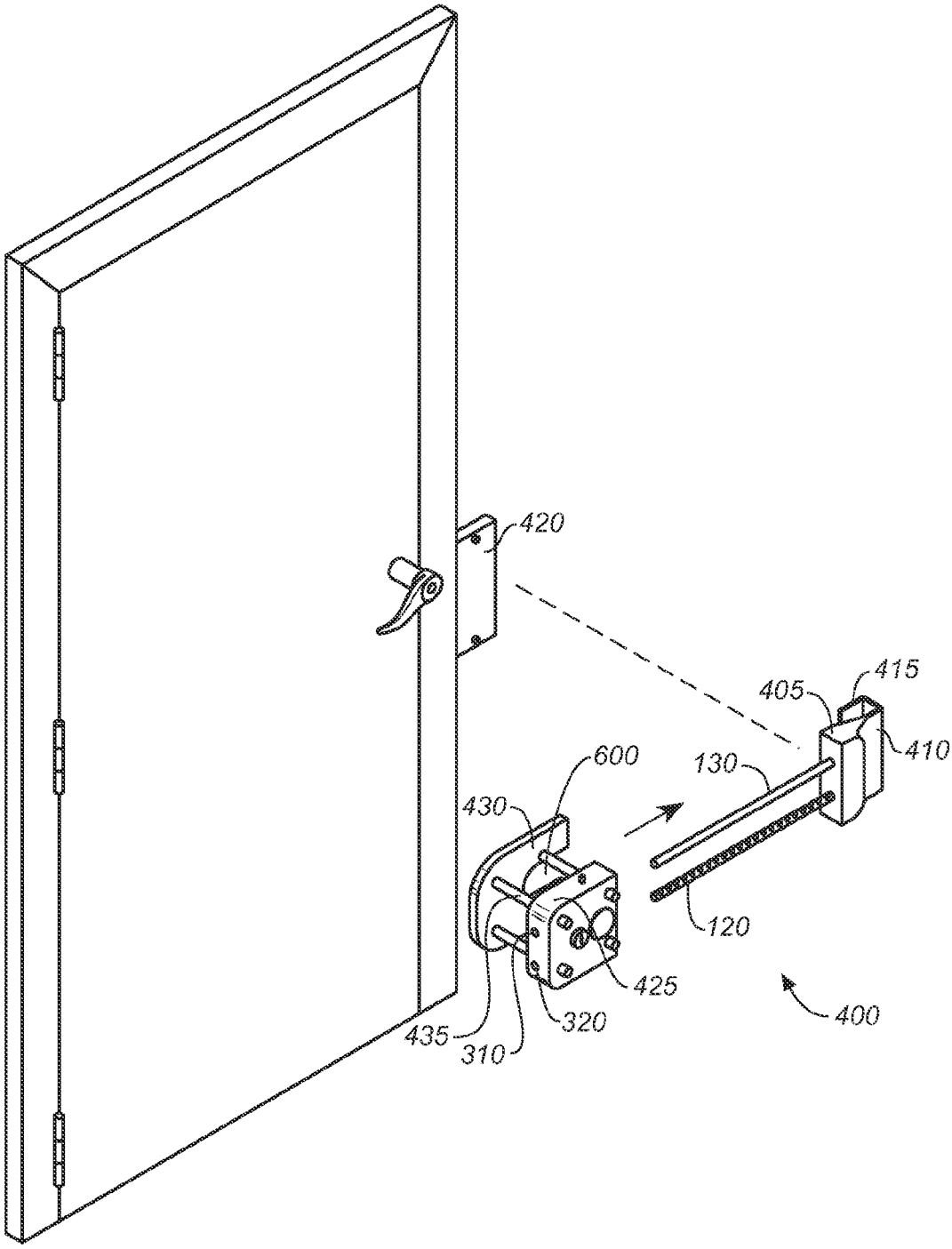
Figure 7:
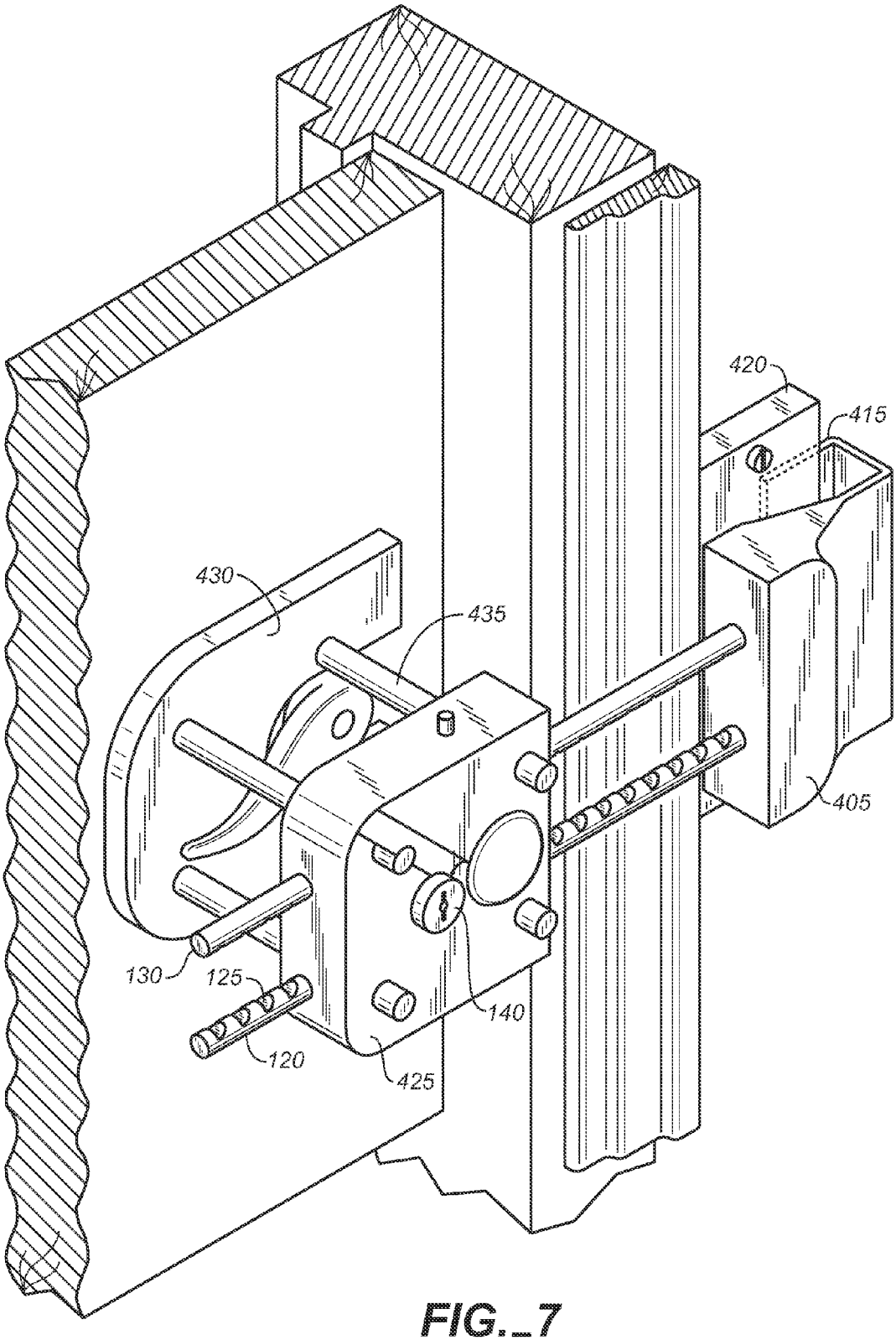

FIG. 6 is a perspective view of a third embodiment of the multipurpose portable lock 400 in the open position. The shackle base and lock body are identical to those in the second preferred embodiment. However, the U-shaped recess in the rectangular mounting plate 430 disposed and generally centered between the mounting shafts 435 to accommodate the insertion of a door handle shaft. FIG. 7 shows the third preferred embodiment installed on a door and in the closed and locked configuration, with the back arm of the channel 415 slidably inserted into the mounting bracket 420, thus securing it firmly.

Figure 8:
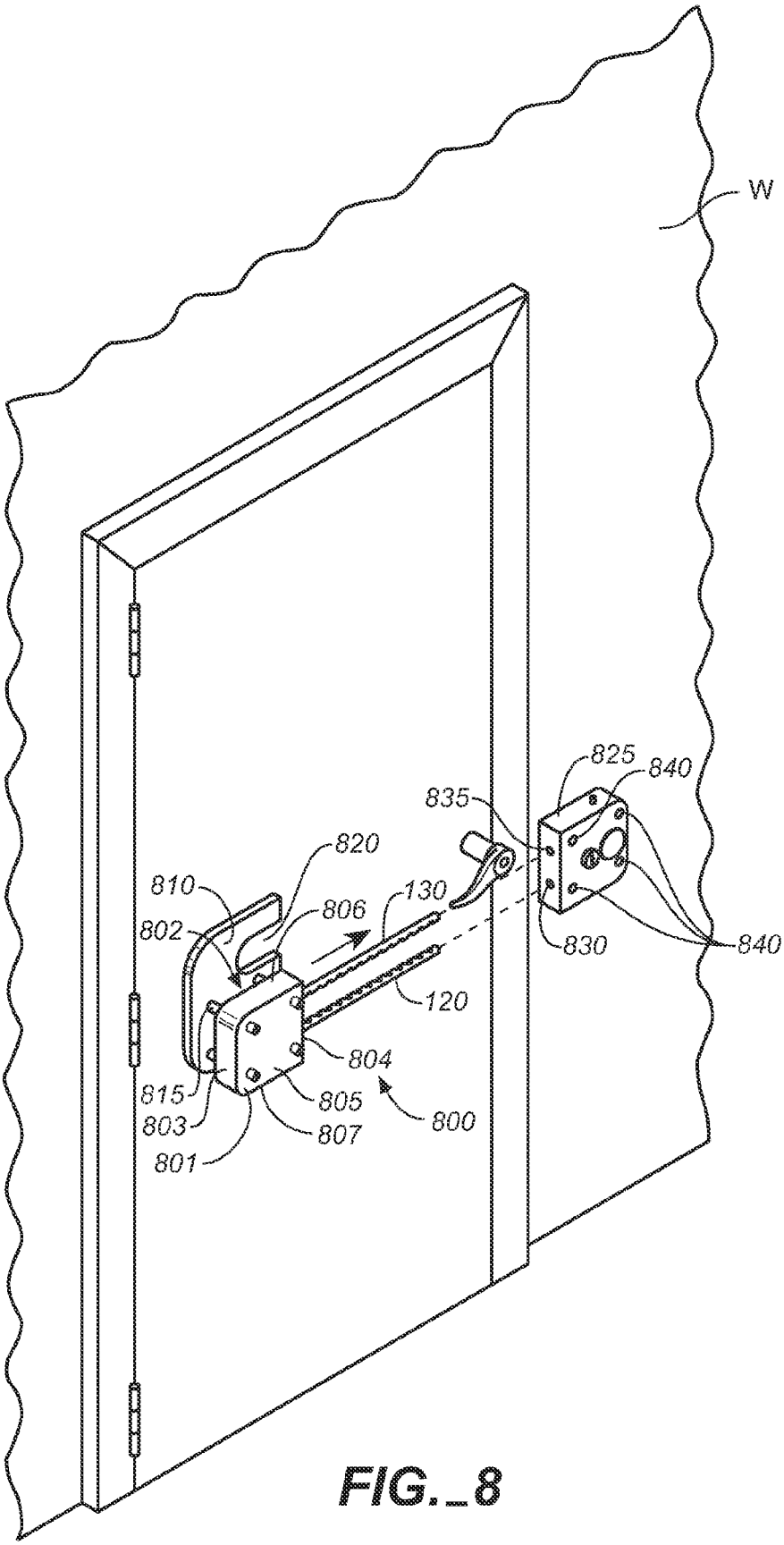

FIG. 8 is a perspective view of a fourth preferred embodiment of the inventive multipurpose portable lock 800, showing it in the open position. The shackle base 805 is a generally rectangular block, having a front side 801, a back side 802, a top 803, a bottom 804, a left side 806, and a right side 807. The shackle base further includes a first rod 120 and a second rod 130 extending from the bottom side in the manner of the other embodiments. The back side of the shackle base 805 is mounted to a mounting plate 810 with a plurality of mounting shafts 815. The rectangular mounting plate 810 has a U-shaped cut out 820 on its right side above the mounting shafts 815 to accommodate the insertion of a door handle shaft.

Figure 9:
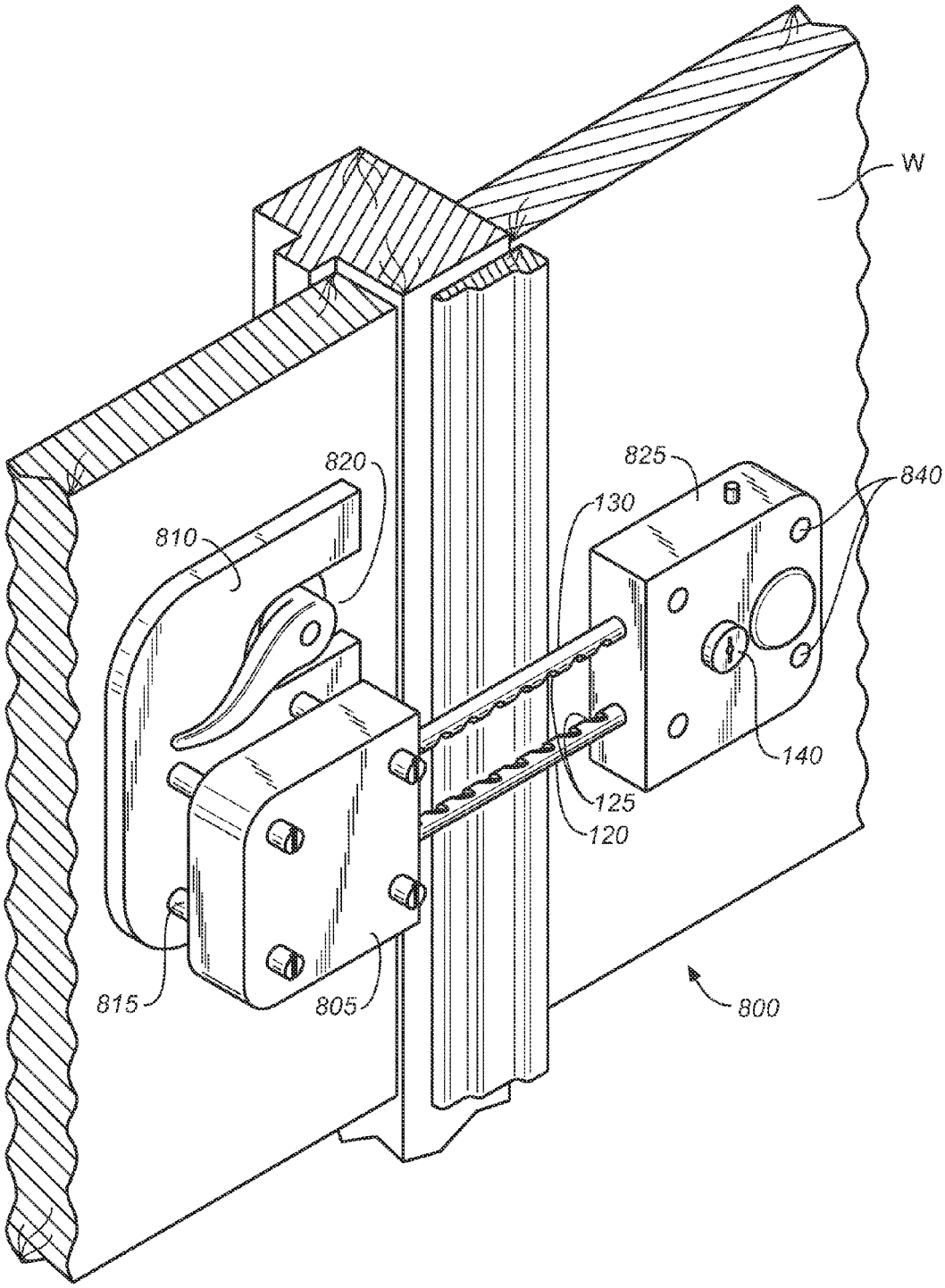

The adjustable lock body 825 is essentially the same as the lock body of the second preferred embodiment, but rather than being coupled with a mounting plate on mounting shafts, it is generally permanently installed on a wall with fasteners 840. FIG. 9 shows the fourth preferred embodiment installed on a door handle and in a closed and locked configuration.

Figure 10:
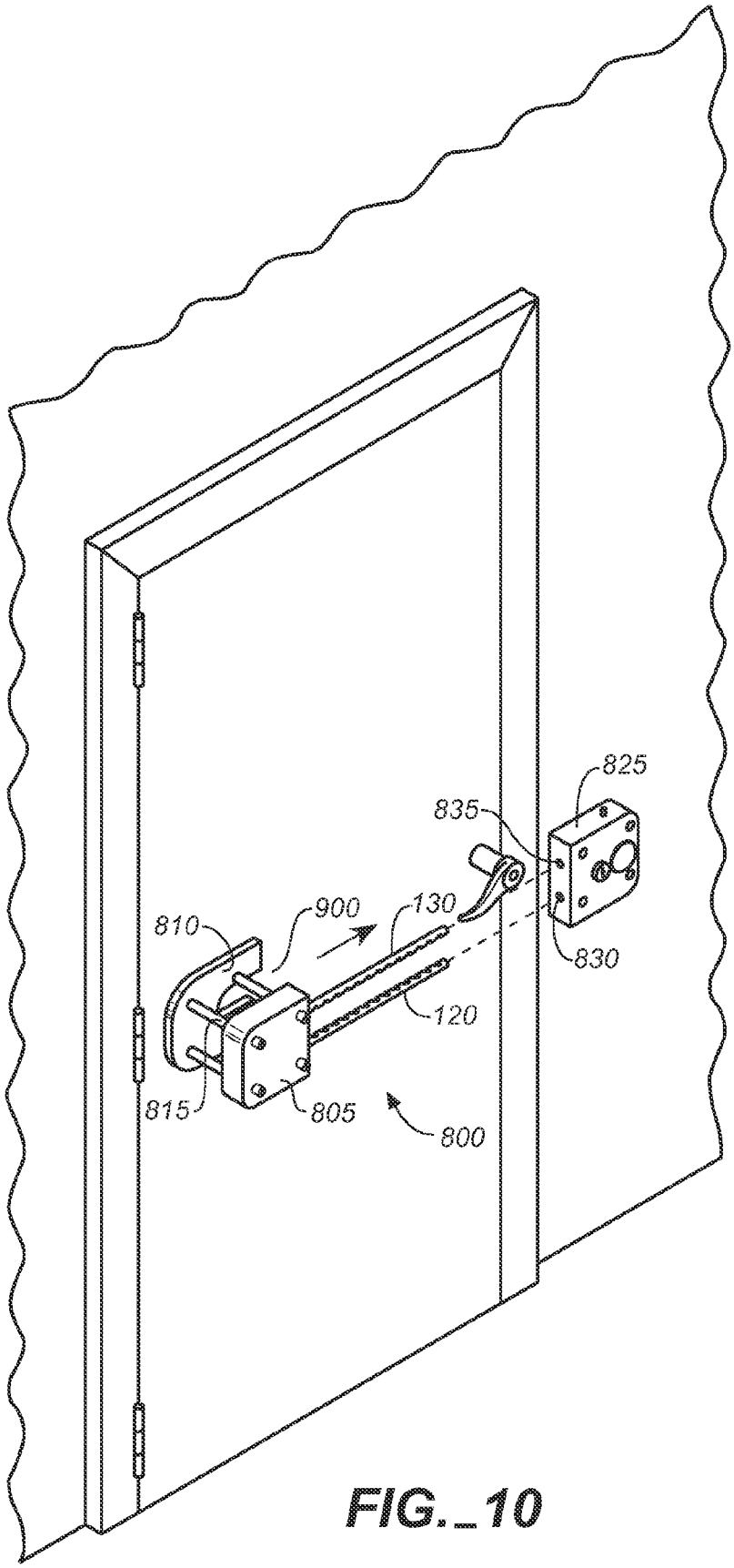
Figure 11:
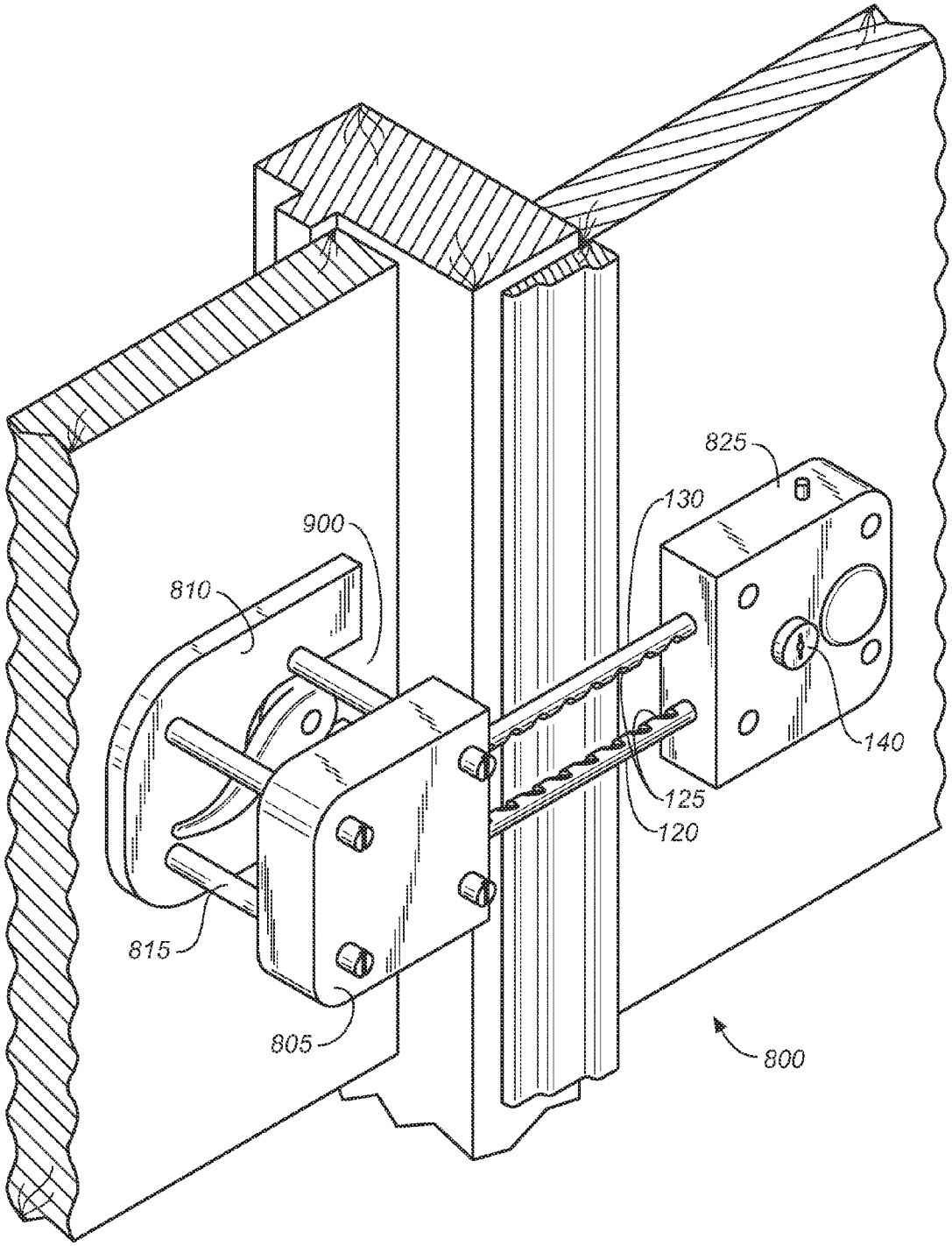

FIG. 10 is a perspective view of a fifth embodiment of the inventive multipurpose portable lock. The only difference between this embodiment and the fourth preferred embodiment is that the U-shaped cut-out or recess 900 on the mounting plate 810 is disposed between the mounting shafts 815, rather than above them.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A multipurpose portable lock, comprising:

a shackle base having a front side, a rear side, a right side and a left side, a top, a substantially planar bottom, a first rod and a second rod, said rods having opposing interior sides with spaced-apart detents;

an adjustable lock body having front and rear sides, a right side, a left side, a bottom side, a top side opposing said bottom side, and upper and lower through holes for slidably receiving said rods;

a mounting plate and mounting shafts for attaching said mounting plate to said rear side of said lock body or said rear side of said shackle base in a spaced-apart relationship; and lock means disposed in said lock body for engaging said rods and thereby to secure said lock body on said rods;

wherein said mounting plate includes a recess permitting placement of said lock around an object or objects to be secured when said rods are secured in the through holes in said lock body.

2. The portable multipurpose lock of claim 1, wherein said front and rear sides of said shackle base are substantially planar.

3. The portable multipurpose lock of claim 2, wherein said front and rear sides of said lock body are substantially planar.

4. The portable multipurpose lock of claim 2, wherein said first and second rods extend in a parallel configuration from said bottom of said shackle base in a plane substantially parallel to the planes of said front and rear sides of said shackle base.

5. The portable multipurpose lock of claim 1, wherein said lock means comprises a key cylinder lock assembly operably disposed in said lock body.

6. The portable multipurpose lock of claim 1, wherein said lock means includes upper and lower dogs disposed between said interior sides of said rods, a spring urging said dogs against said interior sides of said rods, and a lock slide selectively disposed between said dogs when said dogs engage a detent in said rods.

7. The portable multipurpose lock of claim 6, further including at least one release pin disposed in said lock body for urging one of said dogs from engagement with a detent in one of said rods so as to permit said rods to slide within the through holes in said lock body.

8. The portable multipurpose lock of claim 1, wherein said shackle base includes a U-shaped channel extending from said rear side of said shackle base, said channel having a back arm; and further including a mounting bracket for mounting on a planar surface and into which said back arm slidably inserts.

9. The portable multipurpose lock of claim 1, wherein said mounting plate includes said recess which does not extend between any two of said mounting shafts.

10. The portable multipurpose lock of claim 1, wherein said mounting plate includes a recess disposed between at least two of said mounting shafts.

* * * * *